US005140935A

United States Patent [19]

Gruber

[11] Patent Number: 5,140,935

[45] Date of Patent: Aug. 25, 1992

[54] FLUIDIZATION ARRANGEMENT FOR AN ELECTROSTATIC POWDER COATING DEVICE

[75] Inventor: Johann Gruber, Rebstein, Switzerland

[73] Assignee: Wagner International AG, Switzerland

[21] Appl. No.: 679,293

[22] Filed: Apr. 2, 1991

[30] Foreign Application Priority Data

Apr. 4, 1990 [DE] Fed. Rep. of Germany ..... 4010914
Apr. 4, 1990 [DE] Fed. Rep. of Germany ..... 4010915

[51] Int. Cl.[5] ..... B05B 5/00

[52] U.S. Cl. ..... 118/621; 118/629; 118/308; 118/DIG. 5

[58] Field of Search ..... 118/308, DIG. 5, 621, 118/629; 239/345

[56] References Cited

U.S. PATENT DOCUMENTS 4,381,728 5/1983 Walling et al. ..... 118/621
4,730,647 3/1988 Mulder ..... 118/308

FOREIGN PATENT DOCUMENTS 0184994 6/1986 European Pat. Off. .
0337132 3/1989 European Pat. Off. .
3611039C1 8/1987 Fed. Rep. of Germany .

*Primary Examiner*—W. Gary Jones
*Assistant Examiner*—Charles K. Friedman
*Attorney, Agent, or Firm*—Hill, Van Santen, Steadman & Simpson

[57] ABSTRACT

A fluidization and conveyor arrangement for electrostatic powder coating devices. The arrangement includes a container pivotable by 180° on a carrying frame, and a cover, having a fluidization plate. A powder discharge tube and a compressed air tube pass through the cover and into the container. A transport package, for example a sack filled with powder, is introduced into the container. The container is then closed with the cover, and is pivoted by 180° to an operating position, in which fluidization and discharge of the powder may be affected.

19 Claims, 4 Drawing Sheets

FLUIDIZATION ARRANGEMENT FOR AN ELECTROSTATIC POWDER COATING DEVICE

BACKGROUND OF THE INVENTION

1. Field of the Invention

The present invention relates to a fluidization and conveyor arrangement for electrostatic powder coating devices.

2. Description of the Related Art

In electrostatic powder coating devices, fluidized powder, in the form of an air-powder mixture, must be supplied to the applicators, or powder guns, with an optimally uniform distribution of powder particles in the powder-air stream. The powder is supplied in original packaging (such as sacks, barrels, boxes or plastic containers) and is subsequently poured into specific preparation containers (such as dressing or processing containers). Preparation containers typically have an inside floor, configured as a porous plate or fluidization plate, an intake of compressed air, and an air discharge line. Upon the admission of compressed air into the preparation container, the powder is deagglomerated by contact with the fluidization plate, and is fluidized into an air-powder mixture. The air-powder mixture is then removed from the fluidized bed and conveyed to the powder gun. In known devices, the loosening and fluidization of the powder is frequently facilitated by vibrators.

One example of such a preparation container is discussed in German Patent 36 11 039. A considerable amount of time is needed to clean such a container. Such a time expenditure is disadvantageous, particularly when frequent changes in the powder color are necessary. One effort to obviate this problem is discussed in European Patent 0 184 994, which proposed removing the powder directly out of the original packaging by suctioning. Such removal can be accomplished by using a lance-like powder extraction device, composed of a suction tube and a plurality of compressed air conduits, that is lowered into the opened original packaging. The powder extraction device fluidizes the powder in the vicinity of the intake orifice of the suction tube, by which the fluidized powder is suctioned out of the packaging. For further loosening of the powder, the original packaging can be placed on a vibrator. Such a powder extraction device eliminates the need for a special preparation container, such that changes in color can be easily and readily implemented. However, as such a device only provides for fluidization of the powder in the region of the suction tube, the powder distribution in the departing powder-air stream is not as uniform as in a powder-air stream derived from a special preparation container having a fluidization plate.

SUMMARY OF THE INVENTION

The present invention provides an electrostatic powder coating device that not only optimizes uniformity of the extracted air-powder mixture, but also provides for a quick change of powder color, as the device of the present invention can be easily and readily cleaned.

In one embodiment, an electrostatic powder coating device includes a container adapted to accept a powder transport package through an opening therein.

A removable cover is provided for selectively covering the container opening. The cover includes a cover casing and a fluidization plate secured inside the cover at a predetermined distance from the casing, thus forming an interspace between the casing and the fluidization plate. A compressed air delivery conduit and a powder discharge conduit pass through respective apertures in the cover and into the interior of the container. A carry frame is pivotably connected to the container to support rotation of the container 180° from an intital rotational position to a second, or inverted position.

Although a special preparation container is used in the apparatus of the present invention, refilling the powder from the transport packaging into the preparation container is unnecessary. In the present invention, the transport packaging can simply be introduced into the container and opened, unlike the previously known devices, in which the powder is directly introduced into the preparation container. Thus, the powder in the present invention does not contact the walls of the preparation container, which facilitiates the cleaning process. The fluidization plate, the compressed air intake and the discharge line are arranged in the removable cover, which also facilitates the cleaning process.

An extremely uniform air-powder mixture is produced in the discharge conduit by tilting the preparation container 180° and introducing compressed air into the preparation container, thereby fluidizing the powder, and producing a fluidized powder bed over the entire cross-sectional area of the preparation container.

DESCRIPTION FO THE PREFERRED EMBODIMENTS

Figure 1:
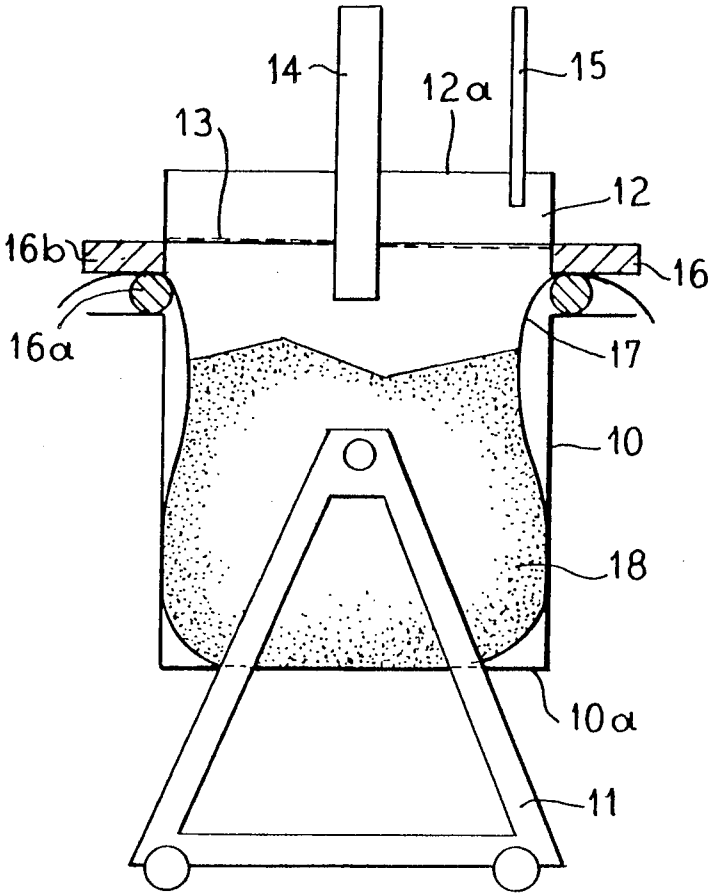
FIG. 1 is a side sectional view of a first embodiment of the present invention, wherein the container is in an initial position.

As illustrated in FIG. 1, a first exemplary embodiment of the electrostatic powder coating device of the present invention includes a container 10, in the form of a bucket having opening at the top. The container, or bucket, 10 is pivotably seated on a carry, or carrier, frame 11. A removable cover 12 selectively closes the opening of the container 10. The removable cover 12 includes a fluidization plate 13, extending over the entire cross-sectional area of the cover on a side of tahe cover facing toward the interior of the container 10. A powder discharge, or powder outlet, conduit 14 passes through a first opening in the removable cover 12. The powder discharge conduit 14 passes through both a cover casing 12*a* and the fluidization plate 13, and opens into the interior of the container 10, in close proximity to the fluidization plate 13. A compressed air delivery conduit 15 passes through a second aperture in the cover 12 and discharges into the interspace between the cover casing 12*a* and the fluidization plate 13.

An annular clamp assembly 16 selectively secures the container 10 to the removable cover 12, and includes a lower clamp ring 16*a* and an upper calmp ring 16*b*.

The apparatus of FIG. 1 operates as follows:

A powder transport packaging, or sack, 17 is filled with powder 18 and is introduced into the container 10, that is open toward the top, from which the removable cover 12 has been removed. The sack 17 is then opened, and its edge is placed over a lower part of the clamp means, namely the lower clamp ring 16*a*. Subsequently, the upper part of the clamp assembly 16, namely the upper clamp ring 16*b*, is put in place, and the two clamp rings 16*a* and 16*b* can be braced relative to one another by way of a spring or other suitable arrangement (not shown). The free edge of the sack is thus securely clamped.

Figure 2:
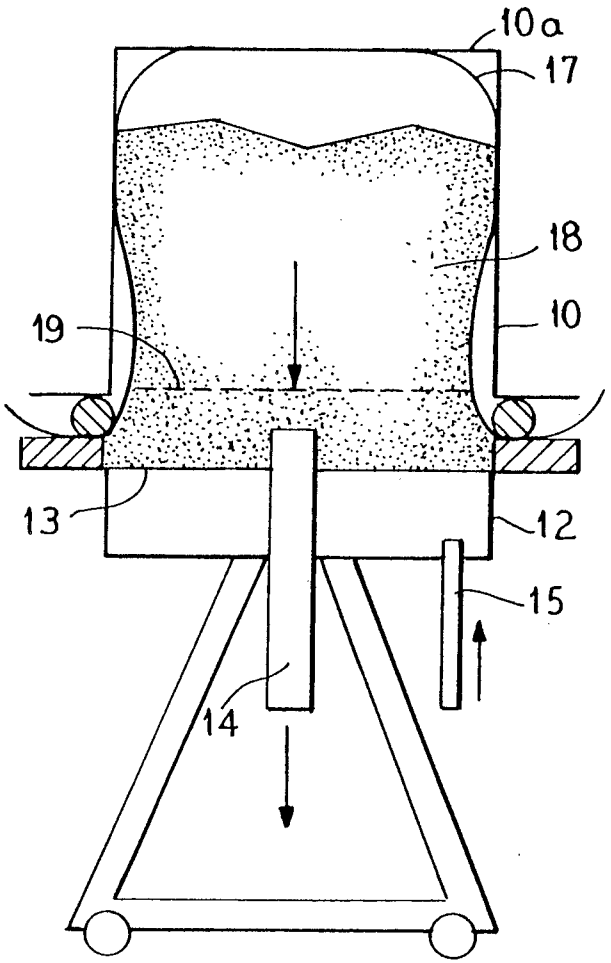
FIG. 2 is a side sectional view of a first embodiment of the present invention, wherein the container is maintained in an inverted position for fluidization of the powder, particularly given powders that are difficult to fluidize.

The removable cover 12 together with the fluidization plate 13, discharge conduit 14 and compressed air delivery 15 is now put in place onto the edge of the container 10, and is sealingly secured to the container 10 by a suitable interlock mechanism (not shown). The container 10, closed by the removable over 12, is now pivoted by 180° from an initial position to a second, inverted position in its carrying frame 11, such that it assumes the "upside down" or inverted position illustrated in FIG. 2. Simultaneously, compressed air is supplied through the compressed air delivery conduit 15 that penetrates through the fluidization plate 13, thereby fluidizing the powder layer situated above the fluidization plate 13. In other words, a suspended fluidized powder bag, as indicated by the broken-line 19 in FIG. 2, is created over the entire cross-sectional area in the lowest region of the powder 18.

The air-powder mixture is conveyed downwardly from the fluidized bed through the powder discharge conduti 14, that may be connected to a pump, an induced draft, or the like, and the air-powder mixture is conveyed to a powder gun (not shown). When all of the powder 18 in the container 10 has been conveyed out through the powder discharge conduit 14, the container 10 is pivoted back into the position of FIG. 1. The removable cover 12 is then removed, thus permitting opening of the clamp assembly 16 and removal of the sack 17, now empty. A new, full powder sack 17 can subsequently be introduced into the container 10.

When the new powder sack 17 contains a powder having a different color consistency, and/or particle size, the removable cover 12 must quickly and easily be cleaned before it is put in place again. The removel cover 12 can be cleaned with, for example an air blast. However, more rapid change in color can be facilitated by providing a plurality of removable covers 12, so that a clean cover 12 is always readily available. Dirty removable covers 12 can then be cleaned during operation of the fluidization device.

It is also contemplated that the clamp mechanism 16 could be configured in a variety of ways. In one simple embodiment, the lower clamp ring 16*a* is attached to the container 10 and the upper clamp ring 16*b* is attached to the removable cover 12. The conduits 14 and 15 connect to flexible lines, for example hoses, in order to enable the tilting of the container 10 by 180°.

Figure 3:
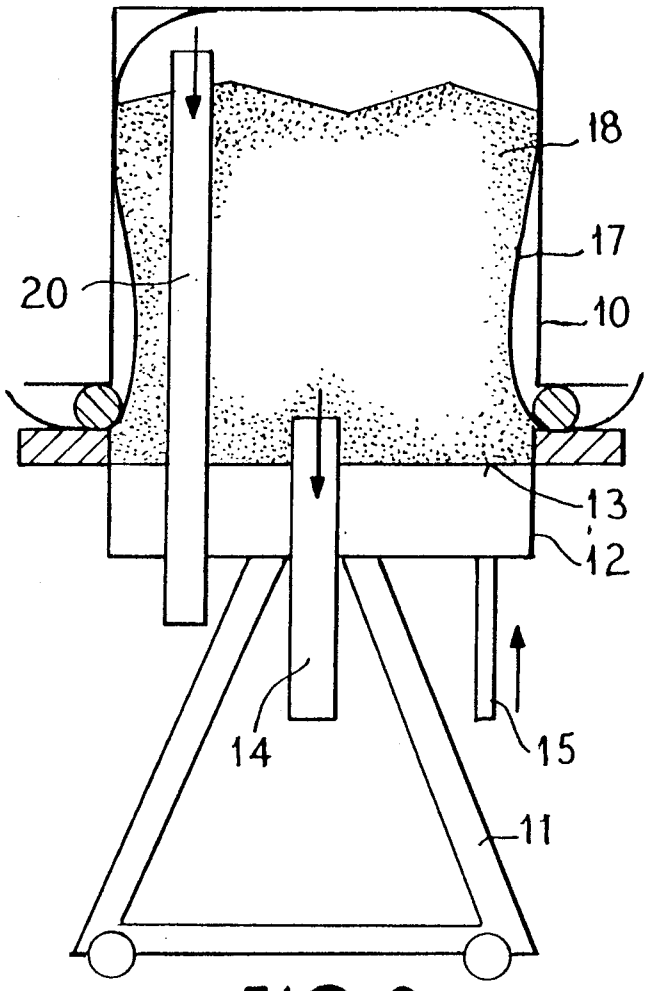
FIG. 3 is a side sectional view of a second embodiment of the present invention wherein the container is maintained in an inverted position for fluidization of the powder, particularly given powders that are difficult to fluidize.

The embodiment illustrated in FIG. 3 corresponds to that of FIGS. 1 and 2, wherein the same reference characters have been selected for the identical parts. Additionally, an air exhaust conduit 20 is provided that penetrates the removable cover 12 and discharges in close proximity to a floor 10*a* of the container 10. It has been found that considerable quantities of air are often required for fluidization, particularly with large transport packages and powders having a high specific weight. Such quantities of air cannot or should not be discharged through the drain pipe, or powder discharge conduit 14 together with the powder 18. The excess exhaust air is thus withdrawn through the additional air exhaust conduit 20 separately from the air-powder mixture flowing in the powder discharge conduit 14.

Figure 4:
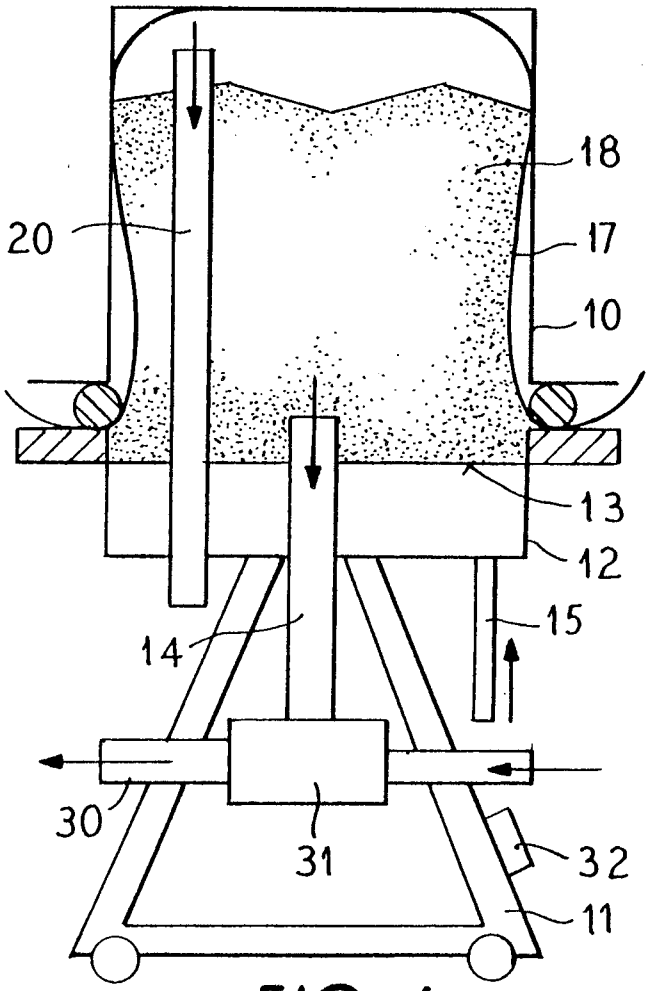
FIG. 4 is a side sectional view of a third embodiment of the present invention wherein the container is maintained in an inverted position for fluidization of the powder, particularly given powders that are difficult to fluidize.

The embodiment illustrated in FIG. 4 differs from the embodiment of FIG. 3 only in that an injector 31 is provided between the powder discharge conduit 14 and a conduit 30 conveying the air-powder mixture to the powder gun. The injector 31 permits dilution of the powder-air stream by reducing powder concentration. Of course, the injector 31 can also be used in the embodiment illustrated in FIG. 1.

Figure 6:
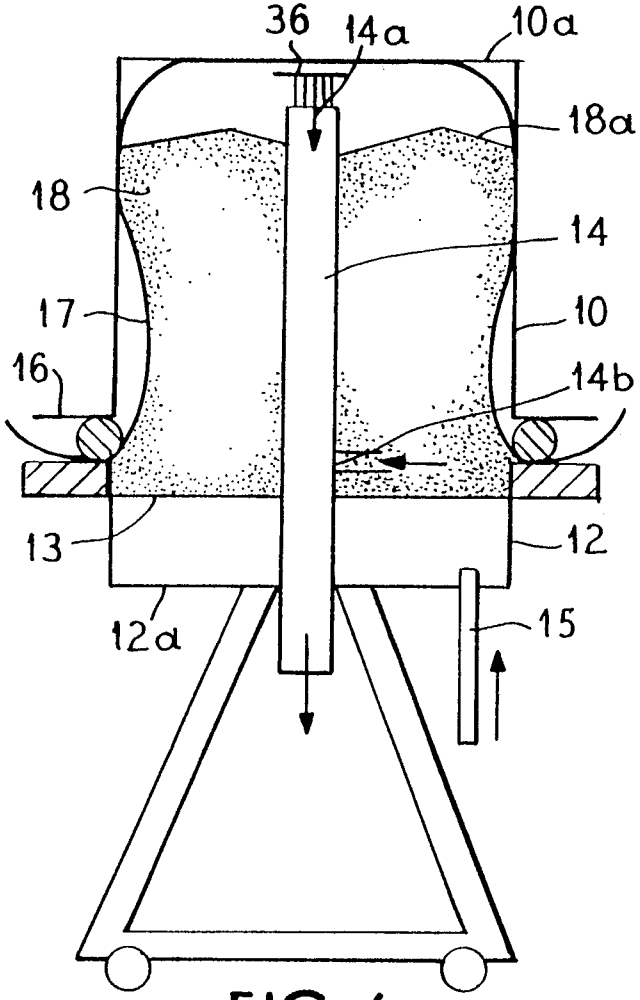
FIG. 6 is a side sectional view of a fifth emboidment of the present invention wherein the container is maintained in an inverted position for fluidization of the powder, particularly given powders that are difficult to fluidize.

In the embodiment illustrated in FIG. 6, additional aire is supplied to the air-powder mixture entering into the powder outlet conduit 14 by an adjustable air admission aperture 14*a*, situated above the powder level. The quantity of additional air can be selectively set by adjusting the effective size of the aperture 14*a*. Tests have shown that such adjustment preserves the uniformity of the powder distribution and the powder-air stream discharged from the apparatus.

The vertical powder outlet conduit 14 is secured to the cover 12, and is substantially centered in the container 10. The admission aperture 14*a* is disposed at the lower end of the conduit 14 in close proximity to the housing floor 10*a*. A powder admission aperture 14*b* for fluidized powder is provided at the opposite end of the conduit 14, in close proximity to the fluidization plate 13. The openings 14*a* and 14*b* may be provided with a flow control mechanism, for example, a diaphragm valve. Thus, the aperture widths of the openings 14*a* and 14*b* are independently adjustable. To facilitate filling operations, the container 10 is pivotably seated on a carrier frame 11 such that it can be pivoted by 180°. With the container in its initial position, the removable cover 12 may be removed, and a powder sack or powder transport package 17, having the powder 18 situated therein, may be introduced into the open top of the container 10. The powder sack 17 is then opened, and the edges of the powder sack 17 are secured to the container 10 with the clamp meachanism 16. Subsequently, the cover 12 is put back in place and connected to the container 10 to form a pressure-tight seal. The container 10 can now be pivoted from the initial position by 180° to the second, inverted position, i.e. the position shown in FIG. 6.

With the container in its inverted position, compressed air is supplied through the conduit 15, a fluidized powder bed forms above the fluidization plate 13, and the air-powder mixture can pass from the fluidized powder bed, through the air-powder admission opening 14*b*, and into the powder discharge conduit 14. Excess compressed air, penetrating the powder mass 18, flows into the space above the powder level 18*a* and through the opening 14*a* into the powder discharge conduit 14. Air from the aperture 14*a* travels downwardly throught the conduit 14 to mix with the air-powder mixture entering through the powder admission opening 14*b*. The resultant powder-air stream emerging from the apparatus is thus supplemented with auxiliary air, with the quantity of auxiliary air being selectively adjustable by varying the width of the air admission aperture 14*a*.

The amount of excess pressure in the container 10 depends on the quantity of fluidization air supplied per unit time, and upon the cross section of the diaphragm of the upper air admission opening 14*a*. The quantity of powder discharged is solely defined by the size of the diaphragm of the lower powder admission opening 14*b*. Since control of both the air and powder are critical to achieving the desired air-powder mixture, it may be particularly expedient to automate the control of powder and air in the device. Such automation can be achieved by adjusting the diaphragms of the openings 14*a* and 14*b* with a motor assemly 34, including a motor drive and a motor-driven control valve. The motor assembly may be provided in the compressed air delivery conduit 15. The motor assembly can be programmable, with the control of the system being facilitated for the operator with a microprocessor, such that the operator merely inputs the desired quantity ratio of the powder-to-air mixture in the discharged powder-airstream, and the actual control events then occur automatically. If the weight of the powder 18 is to be introduced as an additional control factor, an electronic scale can be attached to the container cover 10*a*, in order to identify the weight of the powder sack 17 when it is introduced by generating an electrical signal, and outputting this signal to the microprocessor.

Further, it is possible to provide a plurality of powder discharge pipes for the powder discharge conduit 14 in the container 10, to supply fluidized powder to a plurality of powder guns. In order to prevent the powder from falling directly into the powder discharge conduit 14, shielding hoods 36, 38 can be provided at the openings 14*a* and 14*b*. For example, shielding hood 36 can be provided at the opening of the air admission aperture 14*a*, as illustrated in FIG. 6. Further, the shielding hood 38 can be provided at the powder admission opening 14*b*.

Figure 5:
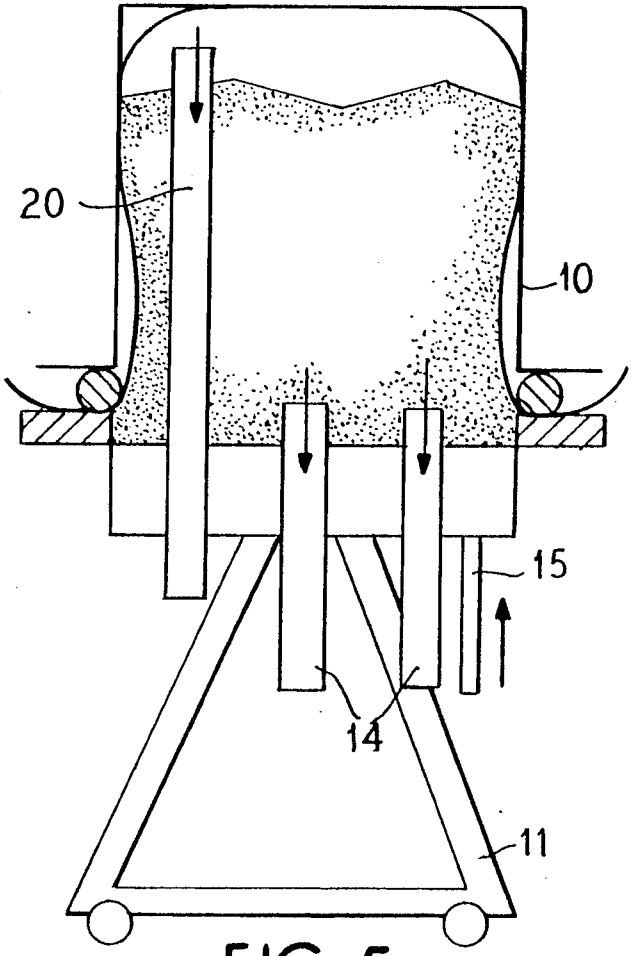
FIG. 5 is a side sectional view of a fourth embodiment of the present invention wherein the container is maintained in an inverted position for fluidization of the powder, particularly given powders that are difficult to fluidize.
Figure 7:
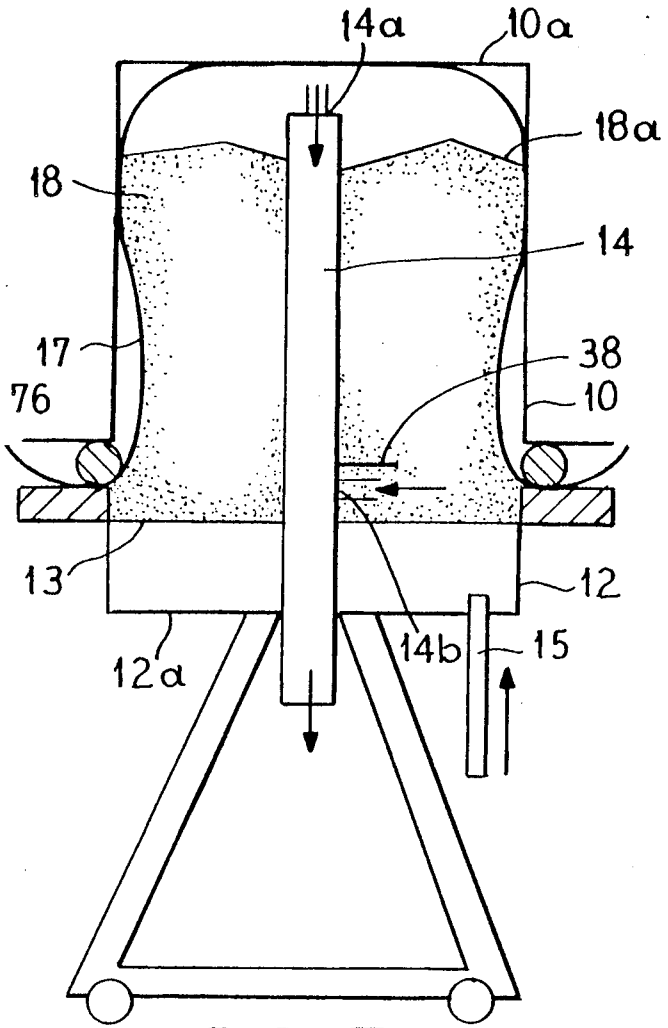
FIG. 7 is a side sectional view of a sixth embodiment of the present invention, wherein the container is maintained in an inverted position for fluidization of the powder, particularly given powders that are difficult to fluidize.

It is to be understood that the principles of the present invention are capable of taking various forms. For example, the size and shape of the container 10, and the particular configuration of the carrying frame 11, could be modified to suit particular coating powders or installation sites. Further, the cover 12 can be secured to the container in various ways, for example with a hinge. It is also contemplated that a plurality of outlet pipes 14 and/or drain pipes 20 could be provided at the cover 12. FIG. 5 shows such an embodiment having two powder discharge pipes 14 that lead to two powder guns, but a greater number could be easily accommodated. Finally, the fluidization process could be enhanced by a vibrator attached to the carrier frame 11 or to the container 10, for example the vibrator 32 indicated in FIG. 4.

Although other modifications and changes may be suggested by those skilled in the art, it is the intention of the inventor to embody within the patent warranted hereon all changes and modifications as reasonably and properly come within the scope of his contribution to the art.

I claim:

1. An electrostatic powder coating device comprising:

a container having an opening, said container adapted to accept a powder transport package;

a removable cover for selectively covering said opening, said removable cover including a cover casing, a fluidization plate secured inside said removable cover at a predetermined distance from said cover casing to form an interspace between said cover casing and said fluidization plate, and a plurality of cover openings.

a compressed air delivery conduit connected to said container through a first cover opening in said cover casing for delivering compressed air into said interspace;

a powder discharge conduit, opening into said container through a second cover opening for transporting fluidized powder out of said container; and a carry frame, pivotably connected to said container, capable of rotatably supporting said container for 180° of rotation from an initial rotational position to an inverted position.

2. The electrostatic powder coating device of claim 1, further comprising an air exhaust conduit opening into said container through a third cover opening for removng excess compressed air from said container.

3. The electrostatic powder coating device of claim 2, wherein said air exhaust conduit includes a plurality of compressed air pipes.

4. The electrostatic powder coating device of claim 1, wherein said powder discharge conduit is substantially centered in said container, said powder discharge conduit further cmprising an air admission aperture arranged above a powder level in said container when said container is in said inverted position, and a powder admission aperture for removing fluidized powder from said container arranged within said container in the proximity of said fluidization plate of said cover.

5. The electrostatic powder coating device of claim 4, wherein said air admission aperture is variable in size.

6. The electrostatic powder coating device of claim 4, wherein said powder admission aperture is variable in size.

7. The electrostatic powder coating device of claim 4, said powder discharge conduit further comprising a hood-like shielding adjacent to said air admission aperture.

8. The electrostatic powder coating device of claim 4, said powder discharge conduit further comprising a hood-like shieldng adjacent to said powder admission aperture.

9. The electrostatic powder coating device of claim 4, said air admission aperture further comprising a motor-adjustable diaphragm.

10. The electrostatic powder coating device of claim 9, wherein said motor-adjustable diaphragm is automated by a programmable control.

11. The electrostatic powder coating device of claim 4, said powder admission aperture further comprising a motor-adjustable diaphragm.

12. The electrostatic powder coating device of claim 11, wherein said motor-adjustable diaphragm is automated by a programmable control.

13. The electrostatic powder coating device of claim 1, further comprising a clamp assembly between said container and said removable cover for securing said powder transport package inside said container.

14. The electrostatic powder coating device of claim 1, further comprising a vibrator connected to said carry frame.

15. The electrostatic powder coating device of claim 1, further comprising a vibrator connected to said container.

16. The electrostatic powder coating device of claim 1, wherein said powder discharge conduit includes a plurality of powder discharge pipes.

17. An electrostatic powder coating device comprising:

a container having an opening adapted to accept powder transport package;

a powder transport package, containing a fluidizable coating powder, secured within said container;

a removable cover having a first and a second aperture, for selectively covering said openign in said container;

a fluidization plate secured inside said removable cover;

a compressed air delivery conduit, positioned in said first aperture of said removable cover, for delivering compressed air to said fluidization plate;

a powder discharge conduit opening into said container and passing through a second aperture of said removable cover; and a carry frame, said container being pivotably connected thereto, such that said container can be rotated form an initial position in which said powder in said transport package is located substantially below said fluidization plate to an inverted position in which said powder in said transport package is located substantially above said fluidization plate.

18. In an electrostatic powder coating devie, a fluidizing arrangement comprising:

a container;

a removable cover;

a carry frame;

said container having an opening adapted to accept a sack containing a fluidizable substance;

said removable cover selectively covering said opening of said container, said removable cover having at least one aperture through which said fluidizable substance may selectively pass; and said carry frame pivotably connected to said container for rotation of said container from a first position to a second position, said substance passing out of said container only when said container is in said second position.

19. An electrostatic powder coating device comprising:

a container having an opening adapted to accept a sack containing a fluidizable substance;

removable cover means for selectively covering said opening in said container, said removable cover means having an aperture formed therein;

discharge means for discharging said fluidizable substance, said discharge means passing through said aperture in said removable cover means into said container; and support means, pivotably connected to said container, for rotating said container from an initial position to a second position, wherein said substance may be discharged from said container through said discharge means when said containers is in said second position.

* * * * *